United States Patent [19]

Tosaki et al.

[11] Patent Number: 4,603,008

[45] Date of Patent: Jul. 29, 1986

[54] CRITICAL TEMPERATURE SENSITIVE RESISTOR MATERIAL

[75] Inventors: Hiromi Tosaki; Hideo Arima; Akira Ikegami, all of Yokohama; Yasuji Kamata, Hitachi, all of Japan

[73] Assignee: Hitachi, Ltd., Tokyo, Japan

[21] Appl. No.: 749,279

[22] Filed: Jun. 27, 1985

[30] Foreign Application Priority Data

Jun. 27, 1984 [JP] Japan ..... 59-131170

[51] Int. Cl.[4] ..... H01B 1/06

[52] U.S. Cl. ..... 252/518; 338/22 R; 264/61; 264/62; 29/612

[58] Field of Search ..... 252/518; 338/22 R, 22 SD; 264/61, 62, 65; 29/610 R, 612, 621

[56] References Cited

U.S. PATENT DOCUMENTS

| | | | |
|---|---|---|---|
| 3,950,273 | 4/1976 | Jones | 252/518 |
| 3,958,209 | 5/1976 | Soda et al. | 338/22 R |
| 3,960,778 | 6/1976 | Bouchard et al. | 252/518 |
| 3,962,145 | 6/1976 | Matsuo et al. | 252/518 |
| 4,324,702 | 4/1982 | Matsuo et al. | 252/518 |
| 4,347,166 | 8/1982 | Tosaki et al. | 338/22 R |

*Primary Examiner*—Josephine L. Barr

*Attorney, Agent, or Firm*—Antonelli, Terry & Wands

[57] ABSTRACT

Disclosed herein is a critical temperature sensitive resistor material which comprises 60 to 90% by weight of $VO_2$ and 40 to 10% by weight of $RuO_2$. This material exhibits hysteresis of resistance that decreases remarkably over a temperature range in which the resistance varies greatly, and is hence used for measuring the temperature maintaining a high precision.

4 Claims, 1 Drawing Figure

CRITICAL TEMPERATURE SENSITIVE RESISTOR MATERIAL

BACKGROUND OF THE INVENTION

The present invention relates to a critical temperature sensitive resistor material of which the electric resistance changes greatly at a given temperature, and particularly relates to a thermally sensitive low hysteresis resistor material.

Thermally sensitive resistor materials include a critical temperature sensitive resistor material of which the electric resistance changes greatly at a given temperature. That is, a single crystal of $VO_2$ or a sintered body of $VO_2$ exhibits a resistance that changes by a factor of several thousand to several tens of thousands at a temperature of about 68° C. It is said that the phenomenon of the great resistance change is attributed to the fact that $VO_2$ undergoes a change in crystalline structure at a temperature of about 68° C. between the monoclinic system (below 68° C.) and the tetragonal system (above 68° C.), and the fact that the electric conduction mechanism changes from electric conduction mechanism of semiconductor type of a high resistance into electri conduction mechanism of metallic type of a low resistance. Such a change in crystalline structure, i.e., a change which involves migration of atoms cause hysteresis in which change of resistance is delayed during the transient temperature conditions, and resistance characteristics are different between when the temperature rises from a low temperature to a high temperature and vice versa. At a certain temperature of about 68° C., therefore, the resistor material exhibits two resistances that differ greatly. Usually, the temperature width of hysteresis is 2° C. Therefore, the precision for detecting the temperature or for controlling the temperature is ±1° C., which is not adequate for high-precision measurement.

Japanese Patent Publication No. 8547/1971 is quoted to show the state of the art.

SUMMARY OF THE INVENTION

The object of the present invention is to provide a critical temperature sensitive resistor material which is capable of measuring temperature while maintaining a precision higher than that of the aforementioned conventional art.

The above object is accomplished by reducing the hysteresis of electric resistance, that is attained by mixing $VO_2$ and $RuO_2$ together followed by the heat-treatment in order to impart distortion to the crystal structure of $VO_2$ by $RuO_2$.

That is, if distortion is imparted to the crystal structure in advance, the hysteresis of resistance decreases remarkably within a temperature range in which the electric conduction mechanism is changed by phase transformation, i.e., in which the resistance changes greatly. Though the change of resistance is not so abrupt and the resistance ratio decreases to some extent over the temperature range in which the resistance changes greatly, the atoms start to migrate gradually from the distorted crystal structure over the temperature range in which the resistance changes greatly, and the resistance changes gradually. Further, great change in resistance takes place over a broad temperature range. However, the measuring error falls within ±1° C.

Here, the sintered body of $VO_2$ and $RuO_2$ should preferably be composed of 60 to 90% by weight of $VO_2$ and 40 to 10% by weight of $RuO_2$. The sintered product is obtained by effecting the sintering in a nonoxidizing atmosphere of, for example, nitrogen or helium gas at a temperature of 950° C. to 1100° C. for 1.5 hours to 3 hours. The $VO_2$ and $RuO_2$ should preferably have an average particle size of 1 μm to 4 μm.

DETAILED DESCRIPTION OF THE PREFERRED EMBODIMENTS

Figure 1:
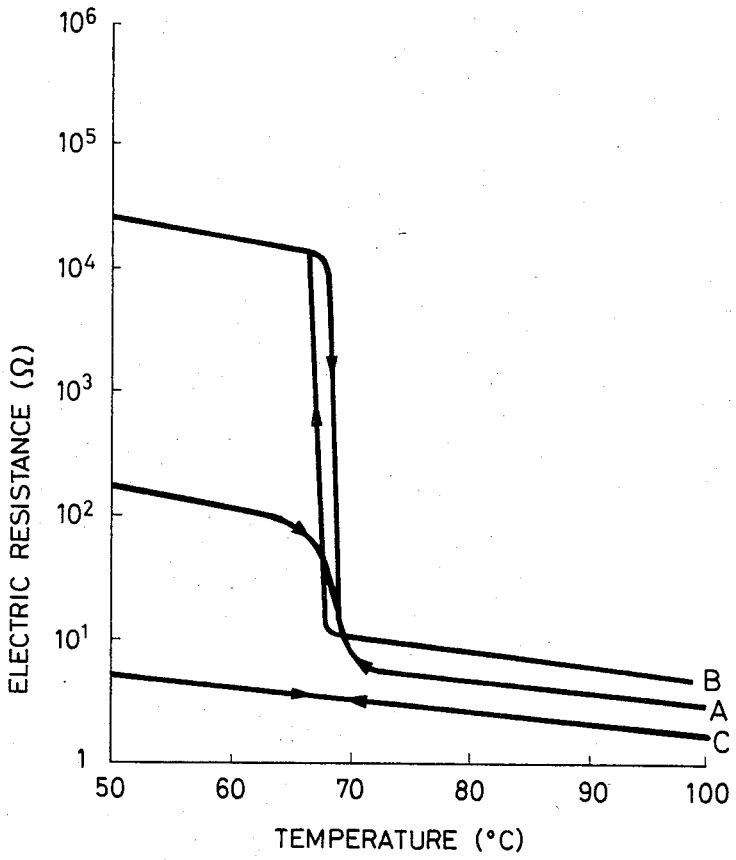
FIG. 1 is a graph showing resistance vs. temperature characteristics of a critical temperature sensitive device using the material of the present invention and of device using materials of different compositions.

The invention will be described below in further detail by way of an embodiment.

$VO_2$ powder having an average particle size of 2 μm and the $RuO_2$ powder having an average particle size of 2 μm were mixed at ratios of examples Nos. 1 to 14 of Table 1. In Table 1, the amount of $VO_2$ gradually decreases from 100% by weight to 50% by weight starting from example No. 1 toward example No. 14. Examples Nos. 6 to 12 lie within the composition range of the present invention in which the amount of $VO_2$ is from 90% by weight to 60% by weight. In examples Nos. 1 to 5, the amount of $VO_2$ is larger than the amounts of the above range. In examples Nos. 13 and 14, on the other hand, the amount of $VO_2$ is smaller than the amounts of the above range. The mixtures were compressed to prepare compact pellets of a square column shape each having sides of 2 mm, 2 mm and 1 mm. The pellets were heat-treated at a temperature of as high as 1000° C. for two hours. The heat-treatment must be effected in a nonoxidizing atmosphere in order to suppress substantially the oxidation of $VO_2$. For this purpose, therefore, the heat-treatment was carried out in an nitrogen atmosphere containing 30 ppm of oxygen.

A silver paste was applied to both surfaces of the thus obtained sintered bodies to form electrodes, and their characteristics were measured. Table 1 shows resistances at 50.00° C., resistances at 100.00° C., ratios of resistances at 50.00° C. to resistances at 100.00° C., and maximum resistance ratios of hysteresis. Further, FIG. 1 shows temperature vs. resistance characteristics of representative samples. A curve A of FIG. 1 represents the data of example No. 10 (70% by weight of $VO_2$) which is encompassed by the embodiment of the invention, a curve B represents the data of a sample which contains $RuO_2$ in an amount smaller than 10% by weight, and a curve C represents the data of a sample which contains $RuO_2$ in an amount greater than 40% by weight.

To obtain a resistance change which is greater than a conventional thermistor element, it is desired that the ratio of resistance at 50.00° C. to resistance at 100.00° C. is greater than 10. It is further desired that a maximum resistance ratio of hysteresis is less than 1.05 such that the difference thereof is smaller than 5%. Moreover, the resistor material should desirably have a resistance of less than 100 kiloohms at 50.00° C. so that it can be employed for practical circuits.

As will be apparent from Table 1, characteristics that satisfy all of the above-mentioned requirements are obtained when the content of $RuO_2$ ranges from 10% by weight to 40% by weight. Little effect of $RuO_2$ is exhibited when its amount is less than 10% by weight. That is, although a great change in resistance is exhibited at around 68° C., the hysteresis is so great that the resistance ratio exceeds 1.05 (curve B of FIG. 1). Further, as the amount of $RuO_2$ exceeds 40% by weight, the resistance change required for the thermally sensitive element becomes small; i.e., ratio of resistance at 50.00° C. to resistance at 100.00° C. becomes smaller than 10. In this case, the change of resistance relative to the temperature decreases as indicated by the curve C of FIG. 1. The curve A of FIG. 1 represents data (temperature vs. resistance characteristics of example No. 10) of a preferred embodiment that lies within the composition range of the present invention mentioned earlier. It will be understood that satisfactory resistance change is exhibited with very little hysteresis. Accordingly, the resistor material of the invention makes it possible to measure with high precision, and can be fully adapted to forming a thermally sensitive element for measuring very small changes in temperature.

What is claimed is:

1. A critical temperature sensitive resistor material comprising 60 to 90% by weight of $VO_2$ and 40 to 10% by weight of $RuO_2$.

2. A critical temperature sensitive resistor material according to claim 1, wherein said critical temperature sensitive resistor material is obtained by mixing 60 to 90% by weight of a $VO_2$ powder and 40 to 10% by weight of an $RuO_2$ powder together, and heat-treating the mixture at 950° to 1100° C.

3. A critical temperature sensitive resistor material according to claim 2, wherein the heat-treatment is carried out in nitrogen which contains 30 ppm of oxygen.

4. A critical temperature sensitive resistor material according to claim 1, wherein the ratio of resistance at 50° C. to resistance at 100° C. is greater than 10, and the hysteresis of resistance at a temperature near 68° C. lies within a range of 1.01 to 1.05 in terms of resistance ratio.

* * * * *

TABLE 1

| No. | Composition of thermally sensitive materials $VO_2$ (wt %) | $RuO_2$ (wt %) | Resistance at 50.00° C. $R_1$ (ohms) | Resistance at 100.00° C. $R_2$ (ohms) | Resistance ratio $R_1/R_2$ | Maximum resistance ratio of hysteresis |
|---|---|---|---|---|---|---|
| 1 | 100 | 0 | $35.5^K$ | 7.20 | 4,660 | 2,135 |
| 2 | 99 | 1 | $22.3^K$ | 5.62 | 3,967 | 1,120 |
| 3 | 95 | 5 | $16.5^K$ | 5.53 | 2,984 | 893 |
| 4 | 92 | 8 | $10.8^K$ | 5.47 | 1,974 | 356 |
| 5 | 91 | 9 | $9.86^K$ | 5.36 | 1,840 | 1.10 |
| 6 | 90 | 10 | $4.35^K$ | 4.67 | 931 | 1.05 |
| 7 | 89 | 11 | $1.06^K$ | 4.16 | 255 | 1.04 |
| 8 | 85 | 15 | 638 | 3.95 | 162 | 1.03 |
| 9 | 80 | 20 | 365 | 3.16 | 116 | 1.02 |
| 10 | 70 | 30 | 177 | 2.81 | 63.0 | 1.01 |
| 11 | 65 | 35 | 86.4 | 2.45 | 35.3 | 1.01 |
| 12 | 60 | 40 | 26.5 | 2.03 | 13.1 | 1.01 |
| 13 | 55 | 45 | 10.8 | 1.79 | 6.03 | 1.00 |
| 14 | 50 | 50 | 5.01 | 1.58 | 3.16 | 1.00 |